US008708088B2

(12) United States Patent
Rotole et al.

(10) Patent No.: US 8,708,088 B2
(45) Date of Patent: Apr. 29, 2014

(54) HYDRAULIC PUMP CONTROL ARM AND METHOD

(75) Inventors: David V. Rotole, Bloomfield, IA (US); Eric R. Lang, Ottumwa, IA (US); Tom Nichols, Eldon, IA (US)

(73) Assignee: Deere & Company, Moline, IL (US)

( * ) Notice: Subject to any disclaimer, the term of this patent is extended or adjusted under 35 U.S.C. 154(b) by 942 days.

(21) Appl. No.: 12/262,972

(22) Filed: Oct. 31, 2008

(65) Prior Publication Data

US 2010/0111712 A1 May 6, 2010

(51) Int. Cl.
*F01B 3/00* (2006.01)

(52) U.S. Cl.
USPC ..... 180/307

(58) Field of Classification Search
USPC ..... 417/218, 221; 92/13; 91/505, 506; 180/307
See application file for complete search history.

(56) References Cited

U.S. PATENT DOCUMENTS 2,964,911 A * 12/1960 Rivinius ..... 92/61
5,020,643 A * 6/1991 Redenbarger ..... 188/196 M
5,586,955 A * 12/1996 Wanie ..... 477/99
6,523,635 B1 2/2003 Johnston et al.
7,051,641 B2 * 5/2006 Berg et al. ..... 92/12.2

OTHER PUBLICATIONS

The Eurasian Patent Office Official Action for related Patent Application No. 200901258, dated Nov. 26, 2013, with translation.

* cited by examiner

*Primary Examiner* — Katy M Ebner
(74) *Attorney, Agent, or Firm* — Quarles & Brady LLP

(57) ABSTRACT

Adjustable control arms for dual path hydrostatic pumps have first and second arms interconnected by an eccentric mechanism with a common pivot point on a pivotal control input shaft for the pumps. The control arms are adjusted at a minimal pump output such as 500 r.p.m. by varying the eccentric to achieve equal r.p.m. The throw of the pump arms is adjusted at a maximum pump output r.p.m., such as approximately 4000 r.p.m., to achieve uniform tracking, steering, and directional control from the dual path hydrostatic pumps.

10 Claims, 5 Drawing Sheets

HYDRAULIC PUMP CONTROL ARM AND METHOD

FIELD OF THE INVENTION

The present invention relates to hydraulic drive systems and, more particularly, to control arms for pumps used in such systems.

BACKGROUND OF THE INVENTION

The use of hydrostatic drive systems for agricultural and other work machines has been long established. The hydrostatic drive utilizes the substantially incompressible pressure of hydraulic fluid to variably drive a hydraulic motor with a variable volume hydrostatic pump. The application of this drive to agricultural vehicles is particularly useful in windrowers. By having a dual path, hydrostatic drive operating wheels at outboard portions of the windrower, a maximum of maneuverability is achieved at the end of a field harvesting to achieve minimum turning radiuses. While such a feature adds to the maneuverability of a hydrostatically driven windrower, the variations in pump output can have an impact on the ability of the windrower to track in a straight line and to accelerate in a uniform fashion. This is caused by manufacturing variations in the output of the individual pumps so that one may be more or less the output of the other at given field conditions or forward speed.

It has been a customary practice in the past to adjust the input for hydrostatic pumps by adjusting the overall linkage of a control rod connected between an operator steering and forward motion mechanism and radial arms used to vary the output of the hydrostatic pumps. While this may match the output of the pumps at a given pump output r.p.m., it does not necessarily do so over the entire operating range of the hydrostatic pumps.

What is needed, therefore, is a hydrostatic drive system providing uniform tracking, steering, and maximum speed.

SUMMARY OF THE INVENTION

In one form, the invention is an adjustable control arm assembly for a hydrostatic pump having pivotal control input shaft. The assembly includes a first arm connected to the pump control input shaft to provide a pivotal input and a second arm connected to an operator displacement input. A mechanism interconnects the first and second arms to provide a selectively adjustable pivotal relationship between the first and second arms.

In another form, the invention is a hydrostatic drive system including a dual path hydrostatic transmission with a pair of pumps respectively coupled for the bidirectional supply of fluid to a pair of hydraulic motors, the pumps having a variable bidirectional output controlled by rotary input shafts for each pump. An operator controlled mechanism provides a displacement output that varies the output of the pumps in absolute terms and relative to each other to provide forward speed and turning. A pair of control rods extend from the operator controlled mechanism to adjacent the rotatory input shafts for each pump. Control arm assemblies are connected to the shafts and to the control rods and at least one of the control arms is adjustable. The adjustable control rod has a first arm connected to one of the pump control input shafts to provide a pivotal input thereto. A second arm is connected to one of the control rods and a mechanism interconnects the first and second arms to provide a selectively adjustable pivotal relationship between the first and second arms.

In yet another form, the invention is a method of synchronizing dual path hydrostatic pumps respectively coupled for the bidirectional supply of fluid to a pair of hydraulic motors, the pumps having a variable bidirectional output controlled by pivotal position of rotary input shafts for each pump in response to displacement inputs to control arms. The method includes the step of setting the relative pivotal position of the control arms at a minimal pump output to achieve equal r.p.m. from the pumps and pivoting the pump arms to a maximum r.p.m. position and adjusting the throw of the control arms to achieve equal r.p.m. from the pumps.

DETAILED DESCRIPTION OF THE INVENTION

Figure 1:
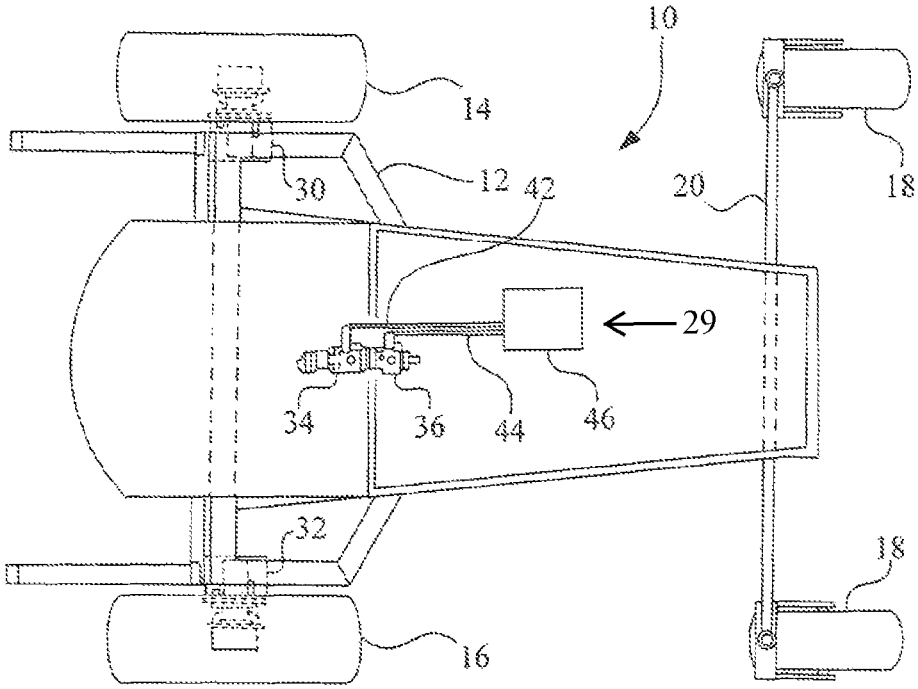
FIG. 1 is a plan view of the work machine with which the present invention is used.

Referring now to FIG. 1, there is shown a self-propelled work machine 10 in the form of a self-propelled windrower having a main frame supported on right and left hand front drive wheels 14 and 16, respectively, and on a pair of rear ground wheels 18, caster mounted to opposite ends of a cross axle 20 that is mounted to the frame 12 for oscillating about a horizontal, fore and aft axis located centrally between the wheels 18. The wheels 14 and 16 are driven by a dual path hydrostatic transmission 29 to right and left hand motors 30 and 32 respectively coupled to the right and left hand drive wheels 14 and 16. Motors 30 and 32 usually have a fixed displacement but may have several selected positions for transport or operating modes. Front and rear, variable displacement, reversible pumps 34 and 36, respectively are fluidly coupled to the motors 30 and 32 by respective pairs of supply and return lines, not shown to enable a better understanding of the present invention. The pumps 34 and 36 provide bidirectional flow to the motors 30 and 32 in varying amounts so that the absolute forward velocity and relative velocity between wheels 14 and 16 may be varied to control forward motion of the work machine 10 and steering. The pumps 34 and 36 have swash plate control arms that are each mounted for pivotal movement from a zero displacement neutral position with increasing rearward and forward movement, respectively affecting increasing displacement and volume of fluids so as to produce increasing forward and reverse driving speeds of the motors 30 and 32.

The pumps 34 and 36 are driven by an appropriate prime mover, also not shown to enable a better understanding of the invention, that may be in the form of a compression ignition or diesel engine providing a rotary torque input to pumps 34 and 36 as well as driving other elements on the work machine 10 such as agricultural processing equipment, not shown. The pumps 34 and 36 have swash plates connected in a known manner to increase or decrease the volume of hydraulic flow so as to affect a variation in r.p.m. of motors 30 and 32. It is to be noted that motors 30 and 32 are typically fixed displacement but may have dual settings for transport and agricultural processing duty cycles. Pumps 34 and 36 have control arms 38 and 40 mounted in a pivotal fashion to set the angle of the swash plate to provide bidirectional flow in a quantity selected to provide absolute forward velocity and steering for the work vehicle 10.

Figure 2:
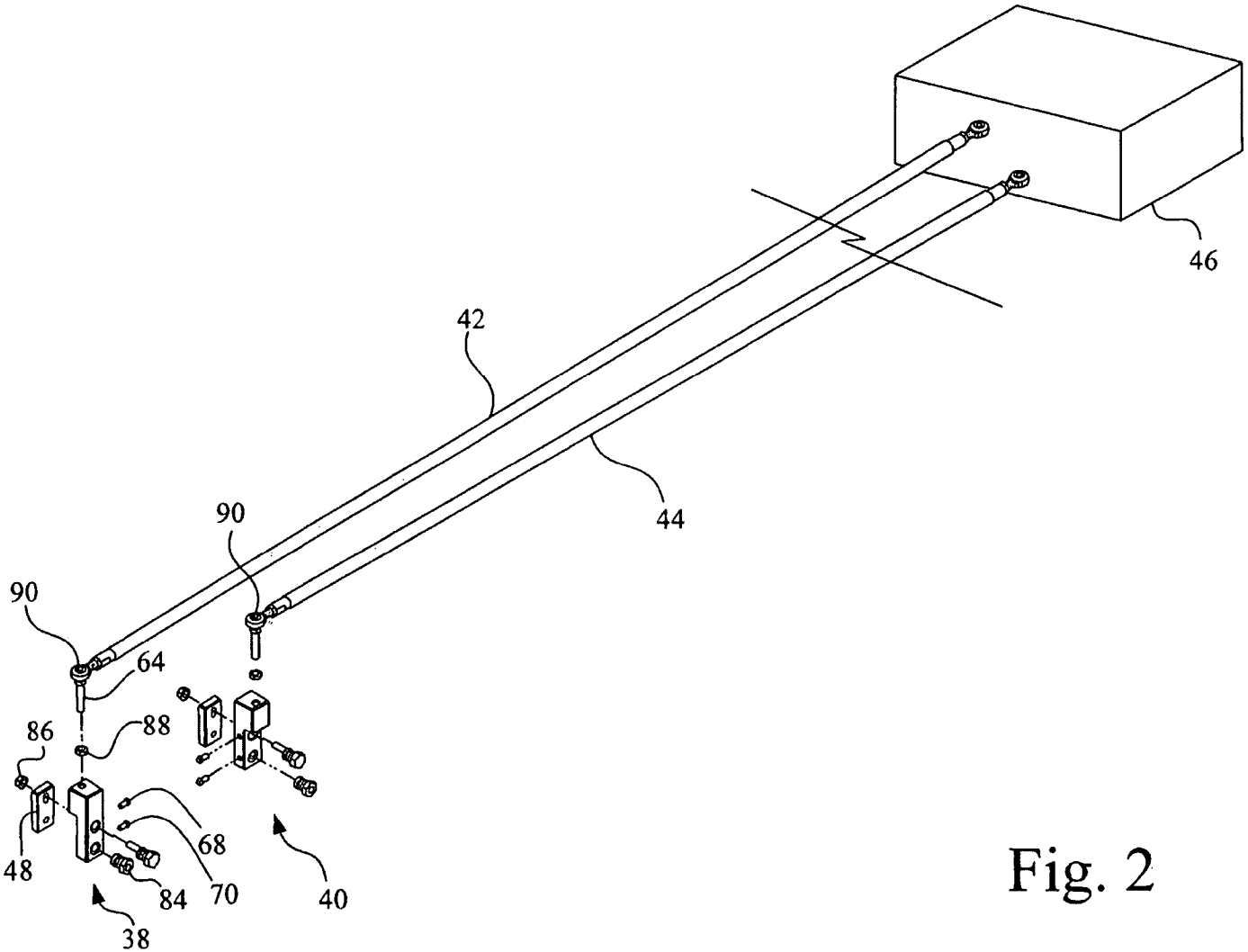
FIG. 2 is a perspective view of an adjustable linkage for the work machine of FIG. 1.
Figure 3:
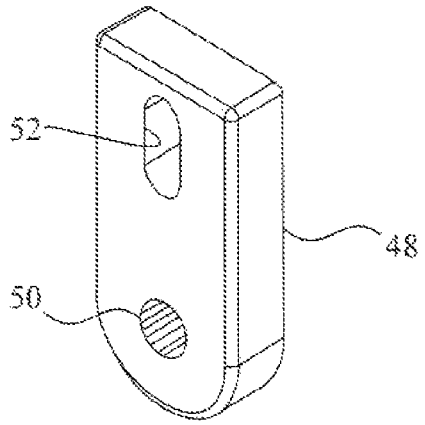
FIG. 3 is a perspective view of one of the components of the adjustable control arm shown in FIGS. 1 and 2.
Figure 4:
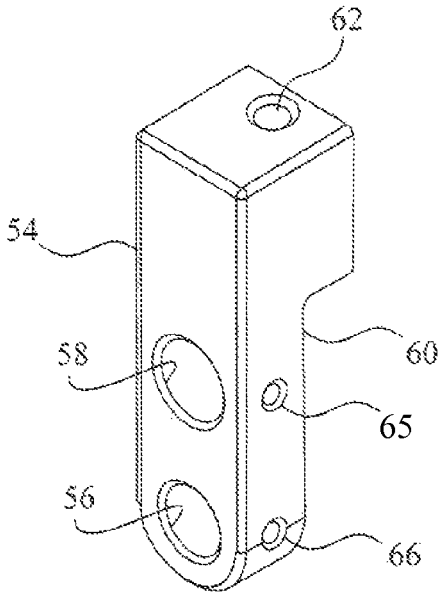
FIG. 4 is another component of the adjustable control arm of FIGS. 1 and 2.
Figure 5:
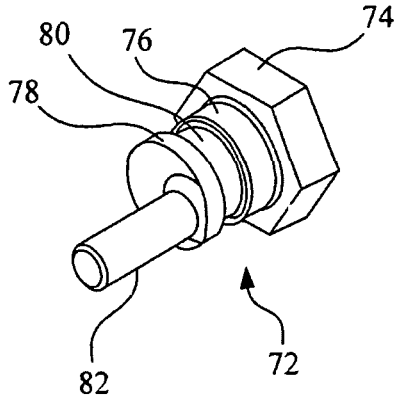
FIG. 5 is a perspective view of another component of the adjustable control arm of FIGS. 1 and 2.

Referring specifically to FIG. 2, control rods 42 and 44 connect to control arms 38 and 40 and extend to an operator control mechanism 46 illustrated schematically. Operator control mechanism 46 provides absolute input in terms of work machine speed and relative output from the pumps 34 and 36 to provide velocity of vehicle 10 in a forward or rearward direction, as well as steering. Operator control mechanism 46 may take many forms, one of which is shown in U.S. Pat. No. 6,523,635, of common assignment with the present invention. The inputs provided by control mechanism 46 provide a displacement input to control rods 42 and 44 to pivot control arm assemblies 38 and 40 to move the vehicle 10 in a forward direction and, rearward direction, and vary the absolute and relative r.p.m. of pumps 34 and 36 to affect steering of vehicle 10.

In accordance with current practice, the length of the control rods 42 and 44 are typically adjusted in terms of length to provide parallel flow for the pumps 34 and 36 to provide straight direction when an operator is desiring to track and harvest crops in a field. However, with current practice, the manufacturing variations in pumps frequently may necessitate the constant correction of steering mechanism to correct for these variations.

In accordance with the present invention, the control arms 38 and 40 are adjustable as described below. Referring particularly to FIGS. 2 through 5, adjustable control arm assemblies 38 and 40 each comprise a first arm 48, shown particularly in FIG. 3. Arm 48 has a splined bore 50 adapted to engage in a fixed rotary relationship, splines (not shown) on one of the pumps 34 and 36 for the pump input control shaft. First arm 48 has an elongated slot 52 at an end spaced from the splined bore 50. As shown particularly in FIG. 4, a second arm 54 has a first bore 56 which is coaxial with the spline bore 50 and a second bore 58 spaced from the axis of bore 56. Second arm 54 has a recess 60 which, in certain applications, will receive the first arm 48. Radially extending threaded bore 62 receives a threaded shaft 64 to set the throw of the adjustable control arms 38 and 40 as described below. Threaded bores 65 and 66 receive set screws 68 and 70, respectively. As shown particularly in FIG. 5, an eccentric adjustment element 72 is received in bore 58. Eccentric adjustment element 72 comprises an appropriate tool engaging head 74, herein shown as a hexagonal head and a pair of annular lands 76 and 78 on opposite sides of a central groove 80. A pin 82 extends axially from element 72 but is offset from the central axis of circular lands 78 and 76. Element 72 extends through bore 58 so that pin 82 is received in radial slot 52 of the first arm 48. Rotation of element 72 causes pin 82 to move first arm 48 in a pivotal relationship relative to second arm 54. The set screw 68 retains pin 72 within bore 58 but also acts as an adjustable element fixing the relative pivotal location of element 72. A second element 84 is received within bore 56 and has an internal threaded section (not shown) that engages a threaded portion of the pump control input shafts (not shown) for pumps 34 and 36. Element 84 acts as a support for the coaxial pivot between arms 48 and 54 to achieve relative pivotal relationship between the two.

As shown in FIG. 2, the control arm 38 has the first element 48 received within recess 60 of the second arm 54 and the first arm 48 for adjustable control arm 40 received on the opposite side of the second arm 54. This is to enable separation of the control rods 42 and 44, given substantially equally placed pump output control shafts. A locknut 86 on a threaded end section of pin 82 enables the first and second arms 48 and 54 to be retained relative to one another. A locknut 88 on threaded shaft 64 enables the relative throw of the arm assemblies 38 and 40 to be adjusted relative to control rods 42 and 44. Conventional swivel connections 90 enable the throw to be adjusted while maintaining the parallel relationship of control rods 42 and 44.

Figure 6:
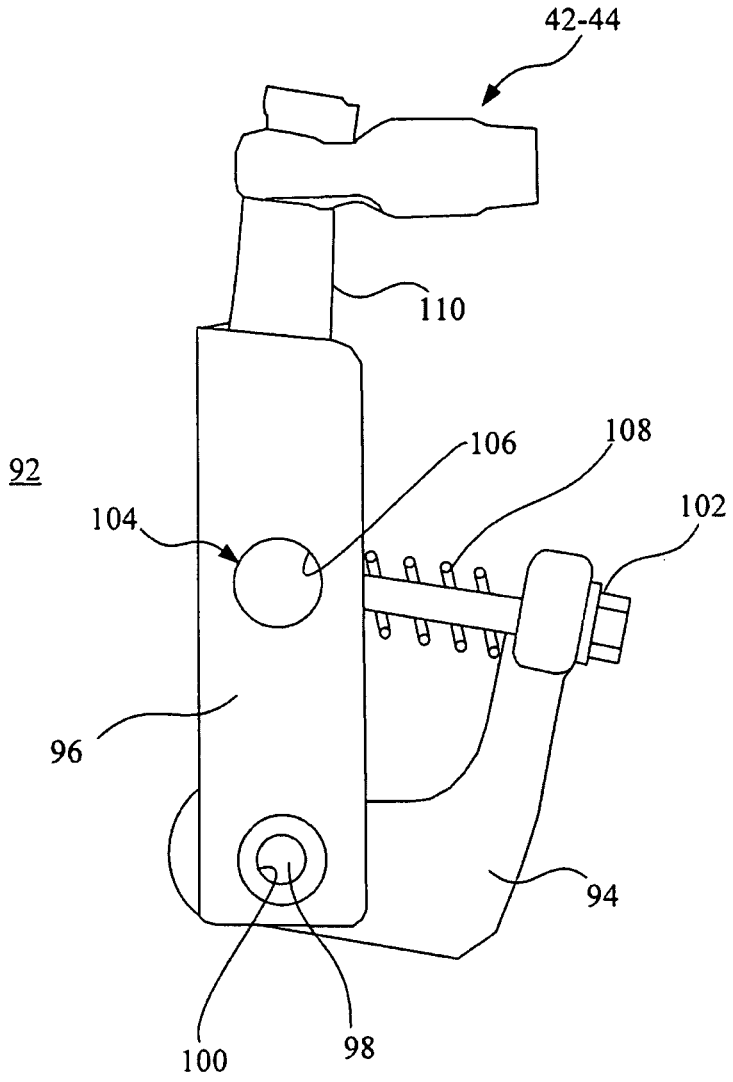
FIG. 6 is a side view of another embodiment of the adjustable linkage.

Referring to FIG. 6, there is shown an alternative embodiment 92 of the mechanism shown in FIGS. 1-5. A first arm 94 is generally L-shaped and is pivotally mounted to a second arm 96 around axis 98. Arm 94 has a splined bore 100 adapted to be received over the pump input control shaft (not shown) for the hydrostatic pumps 34 and 36. The end of arm 94 away from pivot center 98 has a fitting that receives a bolt 102. Bolt 102 extends to, and threadedly engages a cylinder 104 received in a bore 106 in arm 96. This allows a variable angle as the bolt 102 is threaded into or out of cylinder 104 to set the pivotal relationship between arms 94 and 96. A coil spring 108 is carried over bolt 102 and acts against arms 94 and 96 to maintain the pivotal relationship set by the adjustment of bolt 102. A threaded connection 110 connects the arm 96 to each of the control rods 42 and 44.

Figure 7:
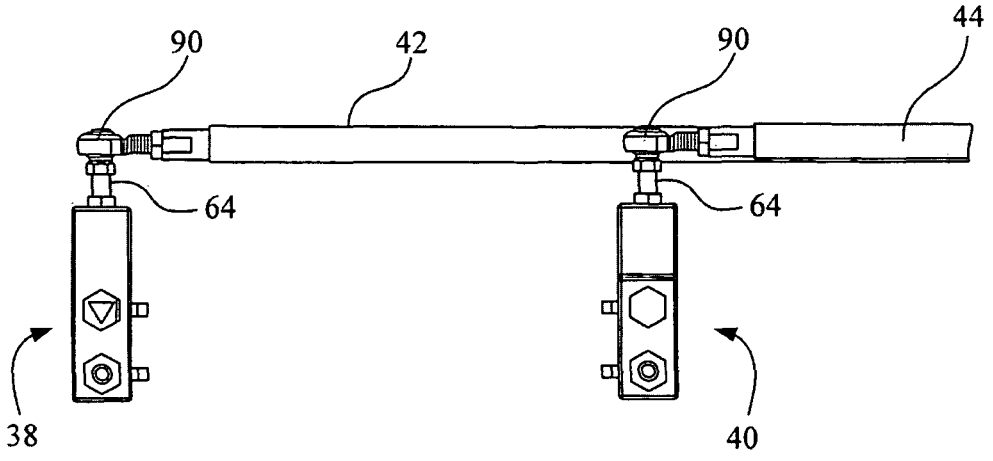
FIG. 7 is a side view showing the adjustment feature of the adjustable control arm of FIGS. 1 and 2.

The adjustable control arms 38 and 40 are adjusted as illustrated in FIG. 7. The pumps 38 and 40 are adjusted in the usual fashion to achieve a pump neutral position in which there is neither forward nor reverse r.p.m. applied to the motors 30 and 32. The adjustable control arms 38 and 40 are set relative to one another to achieve an equal r.p.m. at a relatively low output, for example, 500 r.p.m. This is done by adjusting the eccentric element 72 on one of the arms 38 and 40 to match the output of the two pumps 34 and 36. Once the r.p.m. is equalized at the low level, the control arms 38 and 40 are actuated by the rods 42 to a maximum pump output, for example, approximately 4000 r.p.m. At this point, the threaded connection 64 is adjusted to vary the throw of the control arms 38 and 40 relative to one another. This, in effect, controls the radius of the control arm 38 and 40 relative to the pump control input shafts. By varying the throw of the control arms 38 and 40 at this maximum r.p.m., condition, a uniform control of r.p.m. is achieved throughout the output range of the pumps to account for manufacturing variations between the pumps 34 and 36. The adjustment of the embodiment shown in FIG. 6 is done in a similar fashion. The net result of such a control is that the work machine 10 tracks in a straight, operator controlled line irrespective of its absolute forward velocity and provides uniform turning in response to operator input.

Having described the preferred embodiment, it will become apparent that various modifications can be made without departing from the scope of the invention as defined in the accompanying claims.

The invention claimed is:

1. An adjustable control arm assembly for a hydrostatic pump having a pivotal control input shaft, said assembly comprising:

a first arm connected to said pump control input shaft to provide a pivotal input;

a second arm having a recess configured to receive the first arm and further including at least one threaded bore, wherein the second arm is connected to an operator displacement input;

a first mechanism interconnecting said first and second arms to provide a selectively adjustable pivotal relationship between said first and second arms, said first mechanism including an eccentric element having a head, a first annular land, a second annular land, and a groove located between the first annular land and the second annular land, and an eccentric pin which extends axially from said first mechanism, wherein said first mechanism is configured such that when the first arm and the second arm are engaged, the eccentric element is journaled to the second arm and the eccentric pin is received in a slot in the first arm; and a second mechanism for adjusting the throw of said control arm assembly including a threaded shaft configured to be received within the at least one threaded bore, wherein the threaded shaft sets a throw of the first and second arms.

2. The adjustable control arm as claimed in claim 1 wherein a pivot point between said first and second arms is coaxial with the pump control input shaft.

3. The adjustable control arm as claimed in claim 2 wherein the first mechanism interconnecting said first and second arms moves the first arm relative to the second arm about said pivot point.

4. The adjustable control arm as claimed in claim 1 further comprising a set screw configured to be received within a second threaded bore of the at least one threaded bore in the second arm, for locking the position of said eccentric element.

5. The adjustable control arm assembly of claim 1 wherein said assembly comprises a threaded connection between one of said arms and an operator control input.

6. A hydrostatic drive system comprising:

a dual path hydrostatic transmission including a pair of pumps respectively coupled for the bidirectional supply of fluid to a pair of hydraulic motors, said pumps having a variable bidirectional output controlled by rotary input shafts for each pump;

an operator controlled mechanism to provide a displacement input that varies the output of said pumps in absolute terms and relative to each other to provide speed, direction and turning;

a pair of control rods extending from said operator controlled mechanism to adjacent said rotary input shafts for each pump; and, control arm assemblies connected to said shafts and to said control rods, at least one of said control arms being adjustable and having a first arm connected to one of said pump control input shafts to provide a pivotal input thereto and a second arm having a recess configured to receive the first arm and further having at least one threaded bore, wherein the second arm is connected to one of said control rods;

a first mechanism interconnecting said first and second arms to provide a selectively adjustable pivotal relationship between said first and second arms, said first mechanism including an eccentric element having a head, a first annular land, a second annular land, and a groove located between the first annular land and the second annular land, and an eccentric pin which extends axially from said first mechanism, wherein said first mechanism is configured such that when the first arm and the second arm are engaged, the eccentric element is journaled to the second arm and the eccentric pin is received in a slot in the first arm; and a second mechanism for adjusting the throw of said control arm assembly including a threaded shaft configured to be received within the at least one threaded bore, wherein the threaded shaft sets a throw of the first and second arms.

7. The hydrostatic drive system of claim 6 wherein a pivotal axis for said first and second arms is coaxial with a pump input shaft.

8. The hydrostatic drive system as claimed in claim 7 wherein said first mechanism interconnecting said first and second arms moves said first arm relative to said second arm.

9. The hydrostatic drive system as claimed in claim 6 further comprising a set screw configured to be received within a second threaded bore of the at least one threaded bore in the second arm, for fixing the relationship of said eccentric element.

10. The hydrostatic drive system as claimed in claim 6 wherein said assembly comprises a threaded connection between one of said arms and an operator control input.

* * * * *